US010553194B1

(12) United States Patent
Longo et al.

(10) Patent No.: US 10,553,194 B1
(45) Date of Patent: Feb. 4, 2020

(54) SOUND-MASKING DEVICE FOR A ROLL-UP DOOR

(71) Applicant: HONEYWELL FEDERAL MANUFACTURING & TECHNOLOGIES, LLC, Kansas City, MO (US)

(72) Inventors: Daniel Longo, Kansas City, MO (US); Russell Stewart, Kansas City, MO (US); Bryce Hullet, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 16/208,628

(22) Filed: Dec. 4, 2018

(51) Int. Cl.

| | |
|---|---|
| ***H04R 1/02*** | (2006.01) |
| ***G10K 11/16*** | (2006.01) |
| ***G10K 11/175*** | (2006.01) |
| *H04K 3/00* | (2006.01) |

(52) U.S. Cl.
CPC ..... *G10K 11/175* (2013.01); *H04K 3/82* (2013.01); *H04K 2203/12* (2013.01); *H04R 2201/021* (2013.01)

(58) Field of Classification Search
CPC . H04R 1/00; H04R 1/02; H04R 1/021; H04R 1/025; H04R 1/028; H04R 3/02; H04R 3/025; H04R 3/026; H04R 2201/021; G10K 11/16; G10K 11/175; G10K 13/00; H04K 3/82; H04K 2203/12; H04S 2400/09
See application file for complete search history.

(56) References Cited

U.S. PATENT DOCUMENTS

| | | | | |
|---|---|---|---|---|
| 3,298,455 | A | 1/1967 | Kodaras et al. | |
| 3,980,827 | A | 9/1976 | Sepmeyer et al. | |
| 3,985,957 | A | 10/1976 | Torn | |
| 6,135,408 | A * | 10/2000 | Richter | B60R 11/00 224/183 |
| 7,143,028 | B2 | 11/2006 | Hillis et al. | |

(Continued)

FOREIGN PATENT DOCUMENTS

JP 01012789 A * 1/1989

OTHER PUBLICATIONS

Genius SP-i400—Speaker—for portable use—2 Walt—metallic;Walmart webpage: https://www.walmart.com/ip/Genius-SP-i400-Speaker-for-portable-use-2-Watt-metallic/20470234#about-item.

(Continued)

*Primary Examiner* — Thang V Tran
(74) *Attorney, Agent, or Firm* — Hovey Williams LLP

(57) ABSTRACT

A portable sound-masking device for placing on a roll-up door having a number of horizontally-extending elements. The sound-masking device has a fixture, a magnet, and a transducer. The fixture has an inner face, an outer face, and a pair of spaced-apart tabs protruding from the inner face, the tabs being configured to engage one of the horizontally-extending elements of the roll-up door. The magnet is fastened to the inner face of the fixture and provides a force that tethers the sound-masking device to the roll-up door. The transducer is fastened to the outer face and is configured to emit sound-masking noise.

20 Claims, 3 Drawing Sheets

(56) References Cited

U.S. PATENT DOCUMENTS

| | | | | |
|---|---|---|---|---|
| 7,374,142 | B2 * | 5/2008 | Carnevali | F16M 13/00 224/183 |
| 7,801,570 | B2 | 9/2010 | Cheung et al. | |
| 7,920,822 | B2 | 4/2011 | Chu et al. | |
| 8,229,130 | B2 | 7/2012 | Paradiso et al. | |
| 8,670,986 | B2 | 3/2014 | Arvanaghi et al. | |
| 2007/0154054 | A1 * | 7/2007 | Hayasaka | H04R 1/025 381/386 |
| 2015/0139435 | A1 | 5/2015 | Forrest et al. | |
| 2018/0005621 | A1 * | 1/2018 | Moeller | G06F 3/165 |

OTHER PUBLICATIONS

Portable Magnetic Speaker; Uncommongoods webpage: https://www.uncommongoods.com/product/portable-magnetic-speaker.

Cyber Acoustics Portable Battery Operated Speaker System w/ Magnetic Clamp Travel Design; Micro Center Web Store webpage: https://www.microcenter.com/product/434910/Portable_Battery_Operated_Speaker_System_w-_Magnetic_Clamp_Travel_Design.

* cited by examiner

SOUND-MASKING DEVICE FOR A ROLL-UP DOOR

GOVERNMENT INTERESTS

This invention was developed with government support under Contract No. DE-NA0000622 awarded by the United States Department of Energy. Accordingly, the U.S. Government has certain rights in the invention.

BACKGROUND

Conversations held in corporate, government, or military settings often include subject matter that is secret and/or classified. These conversations often need protection from risks such as eavesdropping and/or inadvertent disclosure. Technical surveillance countermeasure (TSCM) protocols call for protection against these risks using tactics including sweeping an area for bugging or eavesdropping devices, installing insulation that hinders sound from leaving a room, or installing speech-masking speakers inside the walls of a room. These tactics work well in designated secured areas but do not work well in mobile contexts where a proprietary conversation must immediately take place in a room without prior installations that are compliant with TSCM standards.

This background discussion is intended to provide information related to the present invention which is not necessarily prior art.

SUMMARY

The present invention solves the above-described problems and other problems by providing a cost-effective, sound-masking device that allows conversations to take place in a room that would otherwise not meet TSCM standards.

A sound-masking device constructed according to one embodiment of the present invention is configured to attach to a roll-up door having a number of horizontally-extending slats or other elements. The sound-masking device emits sound-masking noise and broadly includes a fixture, a magnet, and a transducer. The fixture is provided for supporting the other components of the device and includes an outer face, an inner face opposite the outer face, and a pair of spaced-apart tabs extending substantially perpendicularly from the inner face. The spaced-apart tabs are configured to engage one of the horizontally-extending elements of the roll-up door so as to prevent rotation of the sound-masking device when activated and provide maximum energy transfer from the transducer to the roll-up door. The magnet is fastened to the inner face of the fixture and firmly but removeably attaches the fixture to the roll-up door. The transducer is fastened to the outer face of the fixture and is configured to emit sound-masking noise. Because the fixture and magnet hold the transducer tightly against the roll-up door, vibrations from the transducer cause the door to vibrate and act as a speaker diaphragm to further mask sound.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
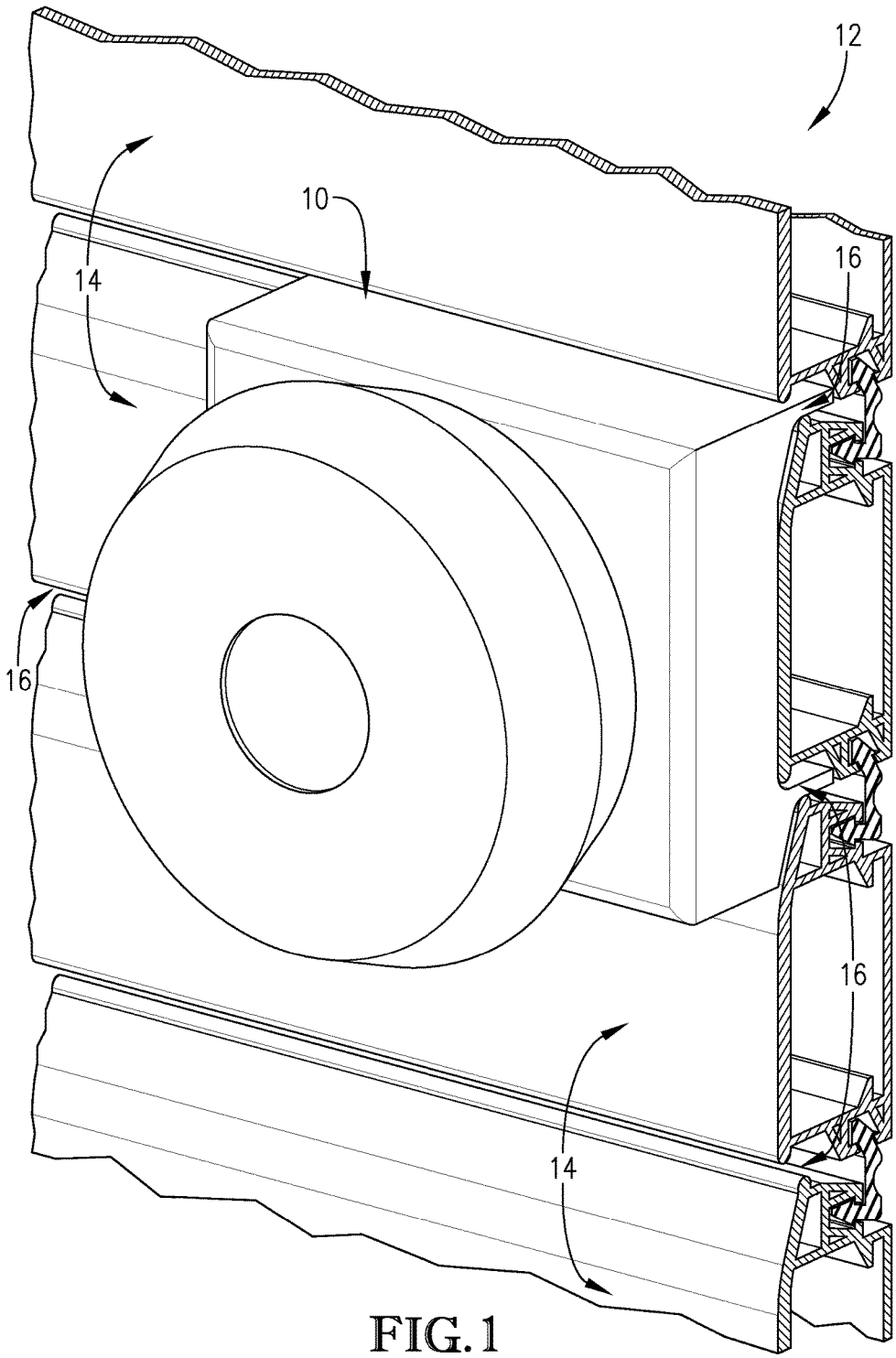
FIG. 1 is a fragmentary view of an exemplary roll-up door having a number of horizontally-extending slats each surrounded by a pair of horizontally-extending grooves.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
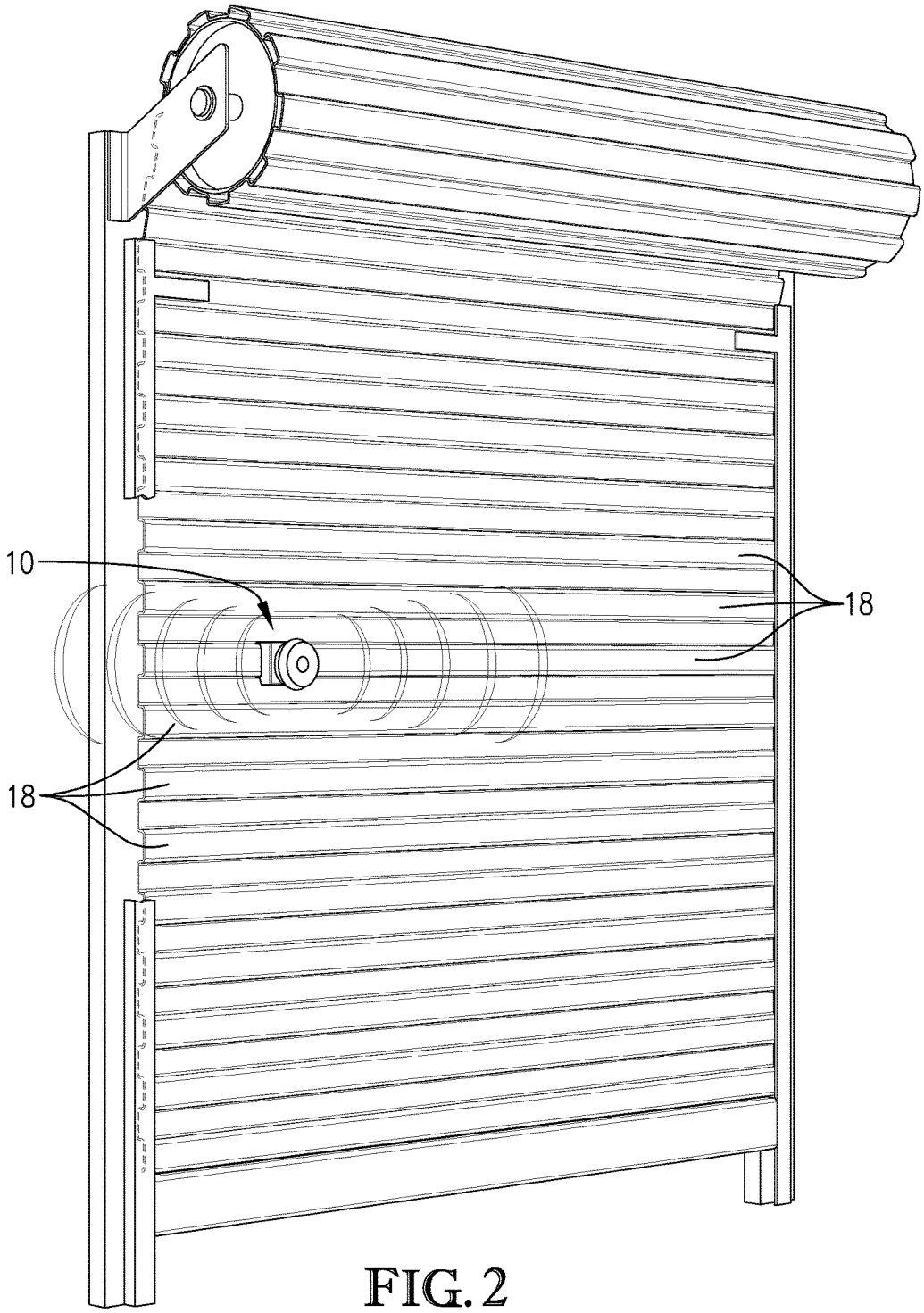
FIG. 2 is a perspective view of an exemplary roll-up door made of corrugated steel having a number of horizontally-extending crests.

The present invention is a sound-masking device 10 for placing on a solid surface so as to emit sound to mask conversations in a room or other area. One embodiment of the sound-masking device 10 is configured for placing on a metal roll-up door 12. The roll-up door 12 may be any type of roll-up door known in the art such as a rolling sheet door, rolling steel door, or rolling fire door. The roll-up door 12 may have a number of horizontally-extending slats 14 or other elements. For example, the roll-up door 12 may have a number of horizontally-extending slats 14 each surrounded by a pair of horizontally-extending grooves 16, as shown in FIG. 1. The roll-up door 12 may be made of a single piece, or multiple pieces, of corrugated steel having a number of horizontally-extending crests 18, as shown in FIG. 2.

Figure 3:
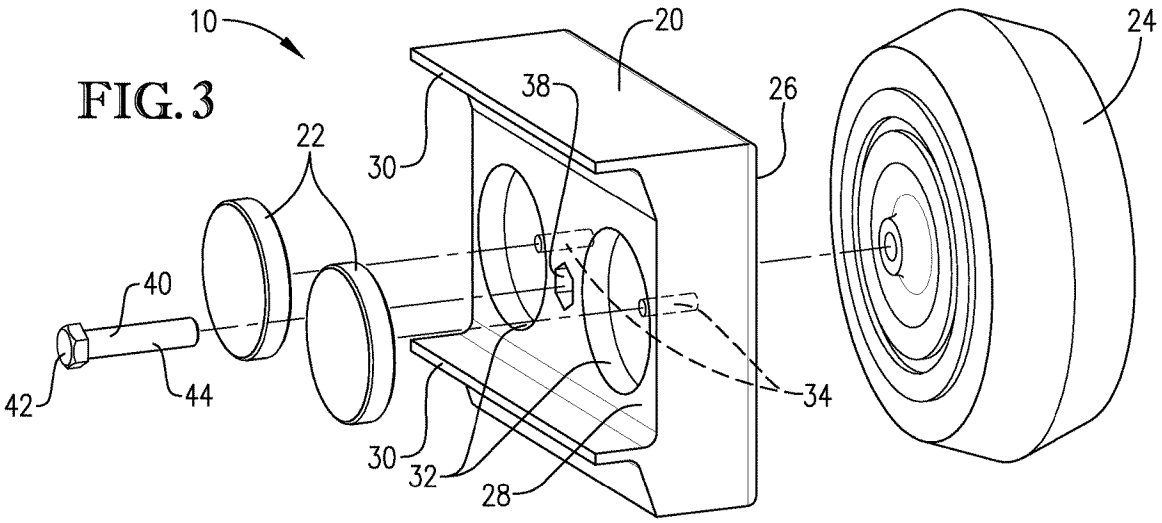
FIG. 3 is an exploded view of a sound-masking device constructed in accordance with one embodiment of the present invention.

A sound-masking device 10 constructed in accordance with one embodiment of the invention is illustrated in FIG. 3 and broadly includes a fixture 20, a pair of magnets 22, and a transducer 24.

The fixture 20 includes an outer face 26, an inner face 28 opposite the outer face 26, and a pair of spaced-apart flanges or tabs 30 extending substantially perpendicularly from the inner face 28. The spaced-apart tabs 30 are configured to fit within the grooves 16 surrounding a slat 14 or otherwise engage one of the slats 14 or any other horizontally-extending elements. The fixture 20 constructed according to this embodiment is form-fitting to the surface of one of the horizontally-extending elements of the roll-up door 12 in order to maximize contact area with the roll-up door 12. The contact area enables vibrations from the transducer 24 to be partially transferred to the roll-up door 12 to cause the roll-up door 12 to vibrate and act as a speaker diaphragm to further mask sound. The spaced-apart tabs 30 also prevent rotation of the sound-masking device 10 when attached to the roll-up door 12.

In some embodiments, the inner face 28 of the fixture 20 may include two magnet recesses 32 with pilot holes 34 at bottom regions of the magnet recesses 32. The two magnet recesses 32 allow for the magnets 22 to sit flush with the inner face 28 to enable maximum contact between the fixture 20 and the roll-up door 12. The pilot holes 34 may be positioned at the center of the magnet recesses 32. The magnet recesses 32 may be of any shape and may be the same shape as the magnets 22. The fixture 20 may also include a through-hole 36 extending from the inner face 28 to the outer face 26 of the fixture 20. The through-hole 36 may have a fastener-head recess 38 formed on the inner face 28. The fastener-head recess 38 also allows for maximum contact area between the fixture 20 to and the roll-up door 12. The fastener-head recess 38 may be any shape, including a hexagonal shape.

Figure 4:
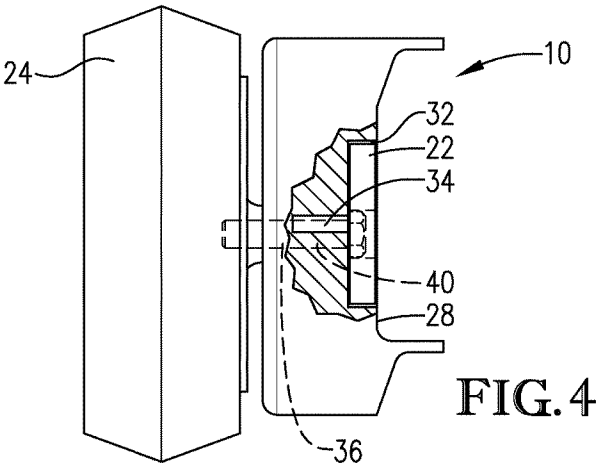
FIG. 4 is a side perspective view of the sound-masking device of FIG. 3.

The magnets 22 are positioned within the magnet recesses 32 of the fixture 20 and fastened thereto with fasteners inserted into the pilot holes 34. The magnets 22 provide a magnetic force that firmly tethers the sound-masking device 10 to the roll-up door 12. The magnetic force is strong enough to hold the sound-masking device 10 in place while not damaging the door 12 during use or if the roll-up door 12 is mistakenly opened while the sound-masking device 10 is still attached. The magnets 22 are also strong enough to hold the transducer 24 tightly against the roll-up door 12. The height of the magnets 22 may be equal to or less than the depth of the magnet recesses 32 so that the top surfaces of the magnets 22 are flush with, or below a surface of, the inner face 28 of the fixture 20, as shown in FIG. 4. In some embodiments, the sound-masking device 10 may include only one magnet 22, or more than two magnets 22. In some embodiments, the magnets 22 may be attached to the fixture 20 using other methods such as epoxy or glue. In other embodiments, the fixture 20 itself is formed of magnetic material so that additional magnets are not required.

The transducer 24 is fastened to the outer face 26 of the fixture 20 and configured to generate sound-masking noise. The transducer 24 may be a speaker, noise-generator, or the like. The transducer 24 may include a power source positioned on the fixture 20 or internal to the transducer 24. The power source may be a battery, capacitor, or the like. Alternatively, or additionally, the transducer 24 may be connected to an external power source. As the transducer 24 vibrates, some of the vibrations are transferred through the fixture 20 and to the roll-up door 12. The vibrations from the transducer 24 then cause the roll-up door 12 to vibrate and act as a speaker diaphragm to further mask sound.

In some embodiments, the transducer 24 may be a wireless speaker having its own power source, amplifier, sound generator, controller, and the like. Such a wireless speaker may be capable of communicating wirelessly with a communication device to receive control signals and information. Wireless communication may include utilizing RF signals and/or data signals that comply with communication standards such as cellular 2G, 3G, or 4G, IEEE 802.11 standard such as WiFi®, IEEE 802.16 standard such as WiMAX, Bluetooth®, or combinations thereof. The information may be related to the generated noise or operational parameters such as volume, power levels, and the like. The wireless speaker may operate according to the control signals and generate the noise commanded from the communication device. The communication device may be a smart phone, tablet, laptop computer, desktop computer, server, or the like. Alternatively or additionally, the transducer 24 may be a wired speaker that connects to an external amplifier with speaker wires, coaxial cables, fiber optic cables, or the like.

Figure 5:
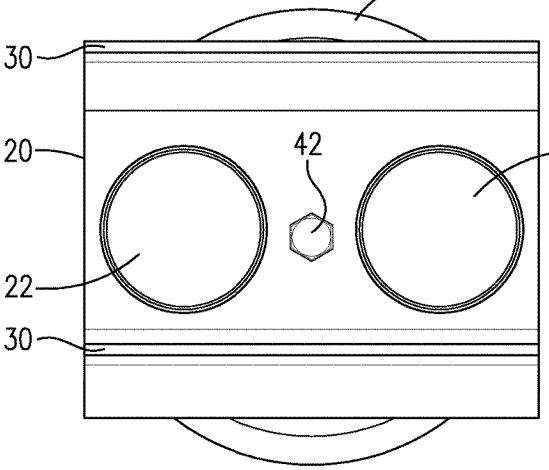
FIG. 5 is a bottom perspective view of the sound-masking device of FIG. 3.

The sound-masking device 10 may include a fastener 40 configured to fasten the transducer 24 to the fixture 20 via the through-hole 36. The fastener 40 may have a head 42 and a cylindrical portion 44. The head 42 sits in the fastener-head recess 38 of the through-hole 36 and may be the same shape as the fastener-head recess 38 so that the head 42 is flush with, or below, the surface of the inner face 28 of the fixture 20. When the head 42 is positioned within the fastener-head recess 38, the fastener 40 is prevented from rotating. The head 42 being flush with, or below, the surface of the inner face 28 allows the fixture 20 to maximize contact area with the roll-up door 12 and thereby efficiently transfer energy from the transducer 24 to the roll-up door 12. The cylindrical portion 44 may extend through the through-hole 36 and fasten into the transducer 24 for affixing the transducer 24 to the outer face 26 of the fixture 20. As shown in FIGS. 3 and 5, the fastener 40 may be a hex bolt 40 having a hexagonal head 42 that fits inside a hexagonal fastener-head recess 38.

In use, the sound-masking device 10 is placed on a roll-up door of a room by positioning the tabs 30 of the fixture 20 into the grooves 16 surrounding a slat 14 or otherwise engage one of the slats 14 or any other horizontally-extending element of the roll-up door 12. Then the transducer 24 is operated so as to generate a sound-masking noise. In some embodiments, a communication device is connected to the transducer 24 and operation of the transducer 24 is performed via the communication device.

Although embodiments of the sound-masking device 10 are specially configured for attachment to roll-up doors, other embodiments may be configured for attachment to other solid surfaces. For example, embodiments of the sound-masking device 10 may be configured to be placed on a metal swinging door, a non-metal door having metal attachments, a metal wall, a metal panel, or the like.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A portable sound-masking device for placing on a roll-up door having a number of horizontally-extending elements, the sound-masking device comprising:

a fixture including
an outer face,
an inner face opposite the outer face, and
a pair of spaced-apart tabs extending substantially perpendicularly from the inner face and configured to engage one of the horizontally-extending elements;
a magnet fastened to the inner face of the fixture to magnetically adhere the fixture to the roll-up door; and
a transducer fastened to the outer face of the fixture and configured to emit a sound-masking noise.

2. The portable sound-masking device of claim 1, the fixture having a magnet recess formed in the inner face, wherein the magnet is positioned in the magnet recess so that a top surface of the magnet is flush with the inner face.

3. The portable sound-masking device of claim 2, the magnet recess having a pilot hole at its bottom region, the pilot hole configured to receive a fastener for fastening the magnet within the magnet recess.

4. The portable sound-masking device of claim 1, the fixture having a through-hole extending from the inner face to the outer face of the fixture.

5. The portable sound-masking device of claim 4, further comprising a fastener that extends through the through-hole and fastens the transducer to the fixture.

6. The portable sound-masking device of claim 5, the through-hole having a fastener-head recess formed on the inner face of the fixture, and the fastener having a head shaped like the fastener-head recess of the through-hole so that the fastener does not rotate when the head is inside the fastener-head recess.

7. The portable sound-masking device of claim 6, wherein the fastener is a hex bolt.

8. The portable sound-masking device of claim 1, further comprising a second magnet recess formed on the inner face of the fixture and a second magnet positioned in the second magnet recess and fastened to the fixture.

9. The portable sound-masking device of claim 1, wherein the transducer is a wireless speaker.

10. The portable sound-masking device of claim 9, wherein the transducer connects to a communication device.

11. A method of masking sound in a room including a roll-up door having a number of horizontally-extending elements, the method comprising:
providing a sound-masking device having
a fixture including
an outer face,
an inner face opposite the outer face, and
a pair of spaced-apart tabs extending substantially perpendicularly from the inner face and configured to engage the horizontally-extending elements;
a magnet fastened to the inner face of the fixture to magnetically adhere the fixture to the roll-up door; and
a transducer fastened to the outer face of the fixture and configured to emit a sound-masking noise;
placing the sound-masking device on one of the horizontally-extending elements; and
operating the transducer of the sound-masking device so as to mask sounds generated within the room.

12. The method of claim 11, wherein the transducer is a wireless speaker.

13. The method of claim 12, wherein the transducer connects to a communication device.

14. The method of claim 11, wherein the magnet is positioned in a magnet recess formed on the inner face so that a top surface of the magnet is flush with the inner face and the inner face is in contact with one of the horizontally-extending elements of the roll-up door.

15. The method of claim 11, wherein the sound-masking device has a fastener protruding through a through-hole that extends from the inner face to the outer face of the fixture, and the fastener fastens the transducer to the fixture.

16. The method of claim 15, wherein the through-hole has a fastener-head recess formed on the inner face of the fixture, and the fastener has a head shaped like the fastener-head recess of the through-hole so that the fastener does not rotate when the head is inside the fastener-head recess.

17. The method of claim 11, wherein the sound-masking device has a second magnet fastened to the inner face of the fixture.

18. A portable sound-masking device for placing on a roll-up door having a number of horizontally-extending elements, the sound-masking device comprising:
a fixture having
an inner face,
an outer face opposite the inner face,
two flanges that protrude substantially perpendicularly from the inner face of the fixture and configured to engage one of the horizontally-extending elements,
two recesses formed in the inner face of the fixture with pilot holes at bottom regions of the recesses, and
a through-hole extending from the inner face to the outer face of the fixture, the through-hole having a hexagonal recess formed in the inner face of the fixture;
two magnets fastened to the fixture and positioned within the recesses of the fixture so that top surfaces of the magnets are flush with the inner face of the fixture;
a transducer configured to emit a sound-masking noise; and
a hex bolt having
a hexagonal head that sits in the hexagonal recess of the through-hole so that the hexagonal head is flush with a surface of the inner face of the fixture and will not rotate when positioned in the hexagonal recess, and
a cylindrical portion that extends through the through-hole and fastens into the transducer for affixing the transducer to the outer face of the fixture.

19. The portable sound-masking device of claim 18, wherein the transducer is a wireless speaker.

20. The portable sound-masking device of claim 19, wherein the transducer connects to a communication device.

* * * * *